US008662616B2

(12) United States Patent
Steurrys et al.

(10) Patent No.: US 8,662,616 B2
(45) Date of Patent: Mar. 4, 2014

(54) METHOD AND SYSTEM FOR ADJUSTING PRINTHEAD VOLTAGE PARAMETERS IN AN INKJET PRINTER

(75) Inventors: Christine Ann Steurrys, Williamson, NY (US); David A. Tence, Tualatin, OR (US); James D. Buehler, Troutdale, OR (US); Yeqing Zhang, Penfield, NY (US); Jeffrey J. Folkins, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 190 days.

(21) Appl. No.: 13/291,539

(22) Filed: Nov. 8, 2011

(65) Prior Publication Data

US 2013/0113855 A1 May 9, 2013

(51) Int. Cl.
*B41J 29/38* (2006.01)

(52) U.S. Cl.
USPC ..... 347/14; 347/19

(58) Field of Classification Search
USPC ..... 347/14, 19
See application file for complete search history.

(56) References Cited

U.S. PATENT DOCUMENTS 4,266,232 A * 5/1981 Juliana et al. ..... 347/10
5,502,468 A * 3/1996 Knierim ..... 347/19
6,302,507 B1 10/2001 Prakash et al.
6,312,078 B1 11/2001 Wen
6,412,901 B2 * 7/2002 Su et al. ..... 347/19
6,428,134 B1 8/2002 Clark et al.
6,454,376 B1 * 9/2002 Su et al. ..... 347/9
6,575,548 B1 6/2003 Corrigan, III et al.
6,793,306 B2 9/2004 Yazdy
7,296,882 B2 11/2007 Buehler et al.
7,461,911 B2 12/2008 Hamazaki
7,556,337 B2 7/2009 Snyder
7,600,836 B2 10/2009 Masuda
7,854,490 B2 12/2010 Snyder
8,333,453 B2 * 12/2012 Dudenhoefer et al. ..... 347/19
2010/0245454 A1 9/2010 Ramakrishnan et al.
2010/0253732 A1 * 10/2010 Sjolander et al. ..... 347/19

* cited by examiner

*Primary Examiner* — Julian Huffman
*Assistant Examiner* — Sharon A Polk
(74) *Attorney, Agent, or Firm* — Maginot, Moore & Beck, LLP

(57) ABSTRACT

A method of operating a printer enables the mass of the ink drops ejected by the printheads in the printer to maintained in an optimal range without measuring the drop mass being ejected by the inkjets in the printheads. After calibration of the printheads, the printheads are operated with electrical signals having different peak-to-peak voltages. The number of inoperable inkjets for each printhead is determined from image data of the ejected ink on the image receiving member and the number of inoperable inkjets for each printhead is compared to a predetermined threshold. The peak-to-peak voltage for the electrical signals used to operate a printhead is adjusted with reference to the number of inoperable inkjets and the predetermined threshold.

14 Claims, 4 Drawing Sheets

METHOD AND SYSTEM FOR ADJUSTING PRINTHEAD VOLTAGE PARAMETERS IN AN INKJET PRINTER

TECHNICAL FIELD

This disclosure relates generally to printheads in inkjet printers, and more particularly, to methods and systems for determining the driving signal parameters that operate the printheads in an inkjet printer.

BACKGROUND

Inkjet printers have printheads that include a plurality of inkjets, each of which ejects liquid ink onto an image receiving member as the member moves past the printhead. The ink may be stored in reservoirs fluidly connected to the printheads or located within cartridges installed in the printer. Various forms of ink include aqueous, oil, solvent-based, UV curable inks, or ink emulsions. Other inkjet printers receive ink in a solid form and then melt the solid ink to generate liquid ink for ejection onto the imaging member. In these solid ink printers, the solid ink may be pellets, ink sticks, granules, pastilles, or other forms. The solid ink pellets or ink sticks are typically placed in an ink loader and delivered through a feed chute or channel to a melting device that melts the ink. The melted ink is then collected in a reservoir and supplied to one or more printheads through a conduit or the like. In other inkjet printers, ink may be supplied in a gel form. The gel is also heated to a predetermined temperature to alter the viscosity of the ink so the ink is suitable for ejection by a printhead.

A typical full width inkjet printer uses one or more printheads to eject a line of ink across a width of an image receiving member. Each printhead typically contains an array of inkjets configured to eject drops of ink across an open gap to the image receiving member. The image receiving member may be a continuous web of recording media, a series of media sheets, or the image receiving member may be a rotating surface, such as a print drum or endless belt. Images printed on a rotating surface are later transferred to recording media by mechanical force generated in a transfix nip that is formed by the rotating surface and a transfix roller. In an inkjet printhead, each inkjet includes an individual piezoelectric, thermal, or acoustic actuator that generates mechanical forces that expel ink from a pressure chamber through an orifice in response to an electrical signal, also referred to as a driving or firing signal. The amplitudes, or voltage levels, of the signals affect the amount of ink ejected in each drop. The firing signal is generated by a printhead controller in accordance with image data. An inkjet printer forms a printed image in accordance with the image data by printing a pattern of individual ink drops at particular locations on the image receiving member. The locations where the ink drops land are sometimes called "ink drop locations," "ink drop positions," or "pixels." Thus, a printing operation can be viewed as the placement of ink drops on an image receiving member in accordance with image data.

Over the operational life of an inkjet printer, the actuators within the printheads that eject the ink from the inkjets often degrade. Many factors contribute to this degradation including age of the printhead, number of inkjet actuations, temperature of the printhead, etc. The temperature-related degradation arising from thermal effects is commonly known as printhead thermal drift. In some printers, the performance of some of the inkjets in one or more printheads begins to degrade. Typically, this inkjet degradation is exemplified in reduced ink drop mass and variation in the placement of the ejected ink drops on the image receiving member. Inkjets that operate with these performance deviations are typically known as weak inkjets. Eventually, the resulting ink drop density and faulty ink drop placement affects image quality. Existing printing systems attempt to compensate for this aging or thermal effect on inkjets using a predetermined aging function that adjusts the electrical firing signal supplied to the inkjets based on various factors, including the temperature of the printhead and the amount of time that the printhead is operated at the temperature. The existing techniques have limitations because individual printheads are affected by temperature differently over the life of a printhead, and the predetermined aging functions do not reliably predict operational changes in each printhead in a printer. Consequently, improved methods and systems for identifying the firing signal parameters that optimally operate printheads in a printer to reduce the number of weak and/or inoperable inkjets would be beneficial.

SUMMARY

A method of operating an inkjet imaging system enables firing signal parameters to be more optimally determined. The method includes operating a first plurality of inkjets in a printhead with a first plurality of electrical signals generated with reference to a first signal parameter, each electrical signal in the first plurality of electrical signals operating only one inkjet in the first plurality of inkjets to eject a first plurality of ink drops onto an image receiving member, generating image data corresponding to the first plurality of ink drops on the image receiving member with an optical sensor, identifying a first number of inoperable inkjets in the first plurality of inkjets with reference to the image data, adjusting the first signal parameter value with reference to the first number of inoperable inkjets, and storing the adjusted first signal parameter in a memory for operation of the first plurality of inkjets in the printhead.

An inkjet printer implements the method to determine the firing signals to be used by the printer more optimally. The inkjet printer includes a plurality of printheads, each printhead in the plurality of printheads having a plurality of inkjets configured to eject ink drops onto an image receiving member, an optical sensor configured to generate image data from light reflected from the ink drops on the image receiving member, a memory configured to store a plurality of peak-to-peak voltage values for each printhead in the plurality of printheads, and a controller operatively coupled to the plurality of printheads, the optical sensor, and the memory, the controller being configured to (1) operate the plurality of printheads with a plurality of electrical signals for each printhead, each plurality of electrical signals for operating a printhead in the plurality of printheads being generated with reference to a first signal parameter stored for the printhead in the memory, each electrical signal in the plurality of electrical signals for operating the printhead operating only one inkjet in the plurality of inkjets in the one printhead to eject a plurality of ink drops onto the image receiving member, (2) identify a number of inoperable inkjets in the plurality of inkjets for each printhead with reference to image data corresponding to the plurality of ink drops on the image receiving member that were generated by the optical sensor, and (3) adjust the first signal parameter stored in the memory for each printhead with reference to the identified number of inoperable inkjets in each printhead.

BRIEF DESCRIPTION OF THE DRAWINGS

The foregoing aspects and other features of a system that generates driving signal parameters to enable robust operation of inkjets in the printheads of a printer are explained in the following description, taken in connection with the accompanying drawings.

DETAILED DESCRIPTION

Figure 1:
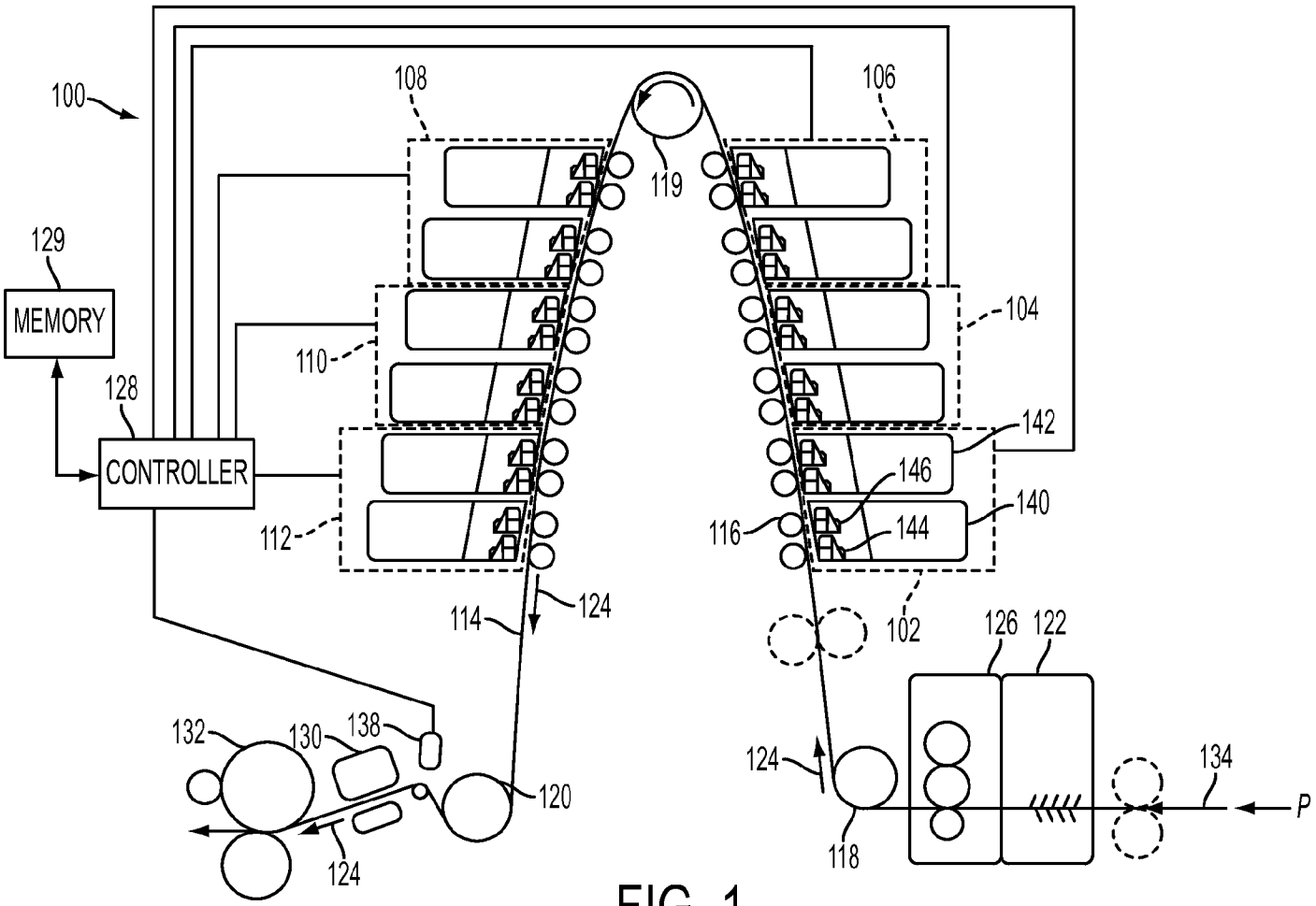
FIG. 1 is a schematic diagram of an inkjet printing system including a plurality of printheads.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that performs a print outputting function for any purpose, such as a digital copier, bookmaking machine, facsimile machine, a multi-function machine, or the like. Also, the description presented below is directed to a system and method that adjust the driving signal peak-to-peak voltage parameter for the printheads in an inkjet printer. Although the system and method are described with reference to an inkjet printer that uses solid ink, the reader should also appreciate that the principles set forth in this description are applicable to inkjet printers that use aqueous inks, gel inks, emulsified inks, or the like.

FIG. 1 depicts an exemplary embodiment of a printer 100 that is configured to identify firing signal parameters with reference to the number of weak and/or inoperable inkjets in one or more printheads. Printer 100 is a continuous web printer that includes six print modules 102, 104, 106, 108, 110, and 112; a media path 124 configured to accept a print medium 114, and a controller 128. The print modules 102-112 are positioned sequentially along a media path 124 and form a print zone for forming images on a print medium 114 as the print medium 114 moves past the print modules.

In printer 100, each print module 102, 104, 106, 108, 110, and 112 in this embodiment provides an ink of a different color. In all other respects, the print modules 102-112 are substantially identical. Print module 102 includes two print sub-modules 140 and 142. Print sub-module 140 includes two print units 144 and 146. The print units 144 and 146 each include an array of printheads that may be arranged in a staggered configuration across the width of both the first section of web media and second section of web media. Each of the printheads includes a plurality of inkjets configured in an array. In a typical embodiment, print unit 144 has four printheads and print unit 146 has three printheads. The printheads in print units 144 and 146 are positioned in a staggered arrangement to enable the printheads in both units to emit ink drops in a continuous line across the width of media path 124 at a predetermined resolution.

Print sub-module 142 is configured in a substantially identical manner to sub-module 140, but the printheads in sub-module 142 are offset by one-half the distance between inkjet ejectors in the cross-process direction from the printheads in sub-module 140. The arrangement of sub-modules 140 and 142 enables a doubling of linear resolution for images formed on the media web 114. For example, if each of the sub-modules 140 and 142 emits ink drops at a resolution of 300 drops per inch (dpi), the combination of sub-modules 140 and 142 emits ink drops at a resolution of 600 dpi. Each sub-module includes a printhead controller. The printhead controller is configured to receive a signal from the controller 128 that identifies the inkjets to be operated by the printhead controller and the time for inkjet operation. The printhead controller generates the electrical driving signals that operate the inkjet ejectors in the printheads operatively connected to the printhead controller with reference to driving signal parameters stored in the print module.

During operation, the media web 114 moves through the media path 124 in the process direction. The media web 114 unrolls from a source roll (not shown) and passes through a brush cleaner 122 and a contact roller 126 prior to entering the print zone. The media web 114 moves through the print zone past the print modules 102-112 guided by a pre-heater roller 118, backer rollers exemplified by backer roller 116, apex roller 119, and leveler roller 120. The media web 114 then passes through a heater 130 and a spreader 132 after passing through the print zone. The media web exits the printer and is wound onto a take-up roller (not shown). The media path 124 depicted in FIG. 1 is exemplary of one media path configuration in a web printing system, but various different configurations may lead the web past different rollers and other components. Alternative media path configurations include a duplexing unit that enables the printer 100 to form ink images on both sides of the media web 114.

The printer 100 includes an optical sensor 138 that generates image data corresponding to light reflected from the media web 114 after the media web 114 has passed through the print zone. The optical sensor 138 is configured to detect, for example, the location, intensity, and/or location of ink drops jetted onto the receiving member by the inkjets of the printhead assembly. The optical sensor 138 also detects light reflected from unprinted portions of the media web 114. The optical sensor 138 includes an array of optical detectors mounted to a bar or other longitudinal structure that extends across the width of the media web 114 in the cross-process direction.

In one embodiment in which the media web 114 is approximately twenty inches wide in the cross process direction and the print modules 102-112 print at a resolution of 600 dpi in the cross process direction, over 12,000 optical detectors are arrayed in a single row along the bar in the optical sensor 138 to generate a single scanline across the image receiving member. The 12,000 optical detectors detect light corresponding to 12,000 pixels arranged on the surface of the image receiving member in the cross-process direction. The term "pixel" refers to one location in a grid-like pattern of potential locations where printed ink drops land on the image receiving member. In one embodiment, each optical detector generates a numeric value corresponding to the intensity of light reflected from one pixel on the image receiving member. The numeric value of the intensity corresponds to the amount of light reflected from the pixel, with a white image receiving member reflecting the most light to generate the highest numeric intensity value while a pixel filled with a black ink drop generates the lowest numeric intensity value.

The optical sensor 138 detects a cross-process position of ink drops formed on the image receiving member 114, and the optical sensor 138 can also detect light streaks in printed images that correspond to an inoperable inkjet in one of the printheads that prints the image. The term "missing pixels" refers to a linear arrangement of pixels extending in the process direction on an image receiving member having an increased reflected intensity level due to at least one inkjet corresponding to the pixels either failing to eject ink drops, failing to eject a mass of ink that accurately corresponds to the driving signal voltage, or ejecting ink drops on an incorrect position of the image receiving member. One or more missing pixels indicate that an inkjet is inoperable, and the cross-process location of each optical detector in the optical sensor 138 may correspond to an inkjet in at least one of the printheads. Thus, as used in this document, an "inoperable inkjet" is an inkjet that failed to eject ink drops, failed to eject a mass of ink that accurately corresponds to the driving signal voltage, or ejected ink drops at an incorrect position of the image receiving member. The controller 128 executes programmed instructions to analyze the image data received from the optical sensor 138 to identify the printheads in the plurality of printheads that have one or more inoperable inkjets. In some multi-color printing systems, each optical detector in the optical sensor 138 includes photodetectors that are selectively sensitive to red, green, and blue (RGB) light. Each optical detector records different amplitudes of reflected light detected by each of the RGB detectors, in addition to a sum of light received by all detectors to generate an RGB digital image of the ink image. The controller 128 can identify the color and corresponding printhead of an inoperable inkjet using the color image data. In other multi-color printing systems, the optical sensor 138 includes a plurality of monochrome photodetectors only that generate signals that correspond to the reflected intensity of white light from the image receiving member. With data identifying the color of the ink drops at the various positions in a test pattern, the controller 128 can identify the color and corresponding printhead in which a weak and/or inoperable inkjet is located from the monochrome image data.

The controller 128 is configured to control various subsystems, components and functions of printer 100. The controller 128 is operatively connected to a printhead controller for each printhead module. The controller 128 provides the parameters for the electrical driving signals that the printhead controller generates to operate the inkjet ejectors in the printheads operatively connected to the printhead controllers in the print modules 102-112. Also, the controller 128 receives data corresponding to one or more images to be produced in a print job. The controller 128 generates signals to the printhead controllers for the print modules 102-112 that indicate which inkjets are to be fired at identified times to produce images on the image receiving member 114. The controller 128 is also connected to the optical sensor 138 to receive image data that the optical sensor 138 generates from light reflected from the media web 114.

The controller 128 stores and retrieves data, including stored program instructions, held in a memory 129. Various embodiments of the memory 129 include volatile data storage devices, such as static and dynamic random access memory (RAM), as well as non-volatile data storage devices, which include magnetic and optical disks, solid-state storage devices including flash memory, and any other data storage device that is configured to store and retrieve data for the controller 128.

In various embodiments, controller 128 is implemented with general or specialized programmable processors that execute programmed instructions. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, and VLSI circuits.

In the printer 100, the controller 128 is configured to identify one or more inoperable inkjets by detecting missing pixels in the image data generated by the optical sensor 138 for a portion of a pattern printed on the web 114. The controller 128 is further configured to identify the actual position of an inoperable inkjet in a printhead from the apparent position of an inoperable inkjet in the image data. The controller 128 executes instructions stored in the memory 129 to implement one or more of the processes described herein that determine an appropriate firing signal magnitude for a printhead with reference to the number of inoperable inkjets detected for a printhead.

Figure 2:
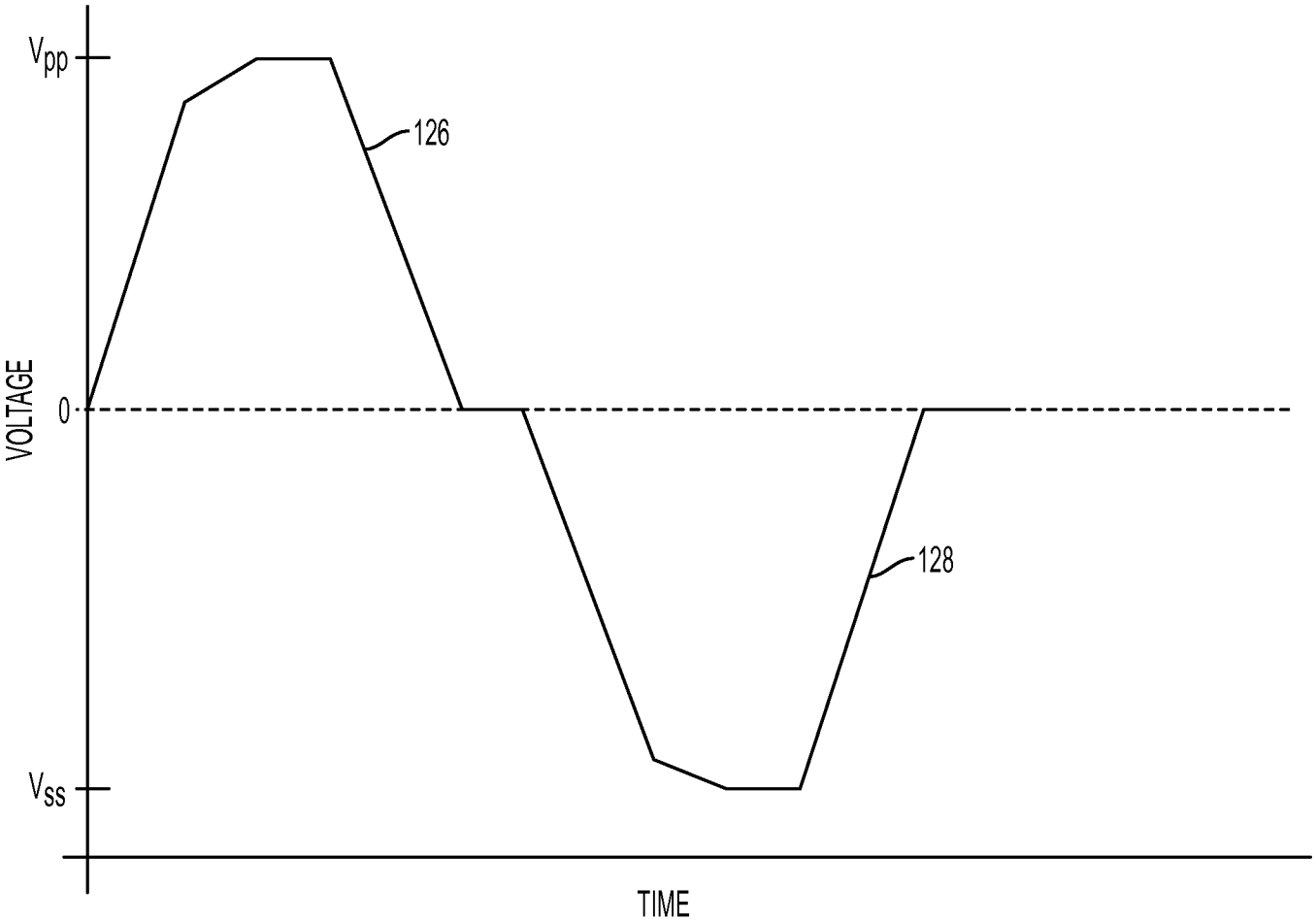
FIG. 2 is a graph of an electrical signal like that sent to the printheads shown in FIG. 1.

As noted above, the controller 128 generates the electrical signals sent to the print modules 102-112 that each printhead controller uses to operate the printheads in each module that are operatively connected to the printhead controller. Each electrical signal generated by the printhead controller operates one inkjet in a printhead. FIG. 2 shows an example of an electrical signal sent from the printhead controller to a printhead in one of the print modules 102-112. The voltage of the electrical driving signal includes a peak voltage $V_{pp}$ 126 and a peak negative voltage $V_{ss}$ 128. The change in voltage between $V_{pp}$ 126 and $V_{ss}$ 128 is referred to as a "peak-to-peak" voltage of the electrical signal. Altering the peak-to-peak voltage of the electrical signal sent to an inkjet changes the mass of the ink drop ejected from that inkjet. For example, the greater the $V_{pp}$ 126 the larger the drop mass of the ejected ink drop. The peak-to-peak voltage of each electrical signal generated by a printhead controller corresponds to a peak-to-peak voltage parameter sent to the printhead controller by the controller 128 that is stored within the printhead module for a printhead controller.

Each printhead in the print modules 102-112 is calibrated during the manufacturing process to ensure that each inkjet in each printhead ejects ink drops having a mass for optimum print quality. However, the actuators of the inkjets in the printheads degrade as a function of time, temperature, and other factors. This degradation causes the actuators to decrease the mass of the ink drops ejected by the actuators. Also, the printhead drop mass calibration performed on a bench fixture at a manufacturer's sight may not perfectly calibrate an inkjet printer and an ink drop mass offset from ideal may occur. Altering the peak-to-peak voltage, as discussed below, compensates for thermal degradation, drop mass calibration offset, and other variations arising in ejected ink drop masses by correcting the mass of the ejected ink drops to restore optimum print quality.

Inkjets in the printheads of the modules 102-112 may not eject ink drops for a number of reasons including receiving an electronic signal having a peak-to-peak voltage that is too high or too low. An electrical signal having a voltage that is too high may produce an ink drop with a mass that is too large for an inkjet to eject. An electrical signal having a peak-to-peak voltage that is too low may produce an ink drop with a mass that is too small for the inkjet to eject.

Figure 3:
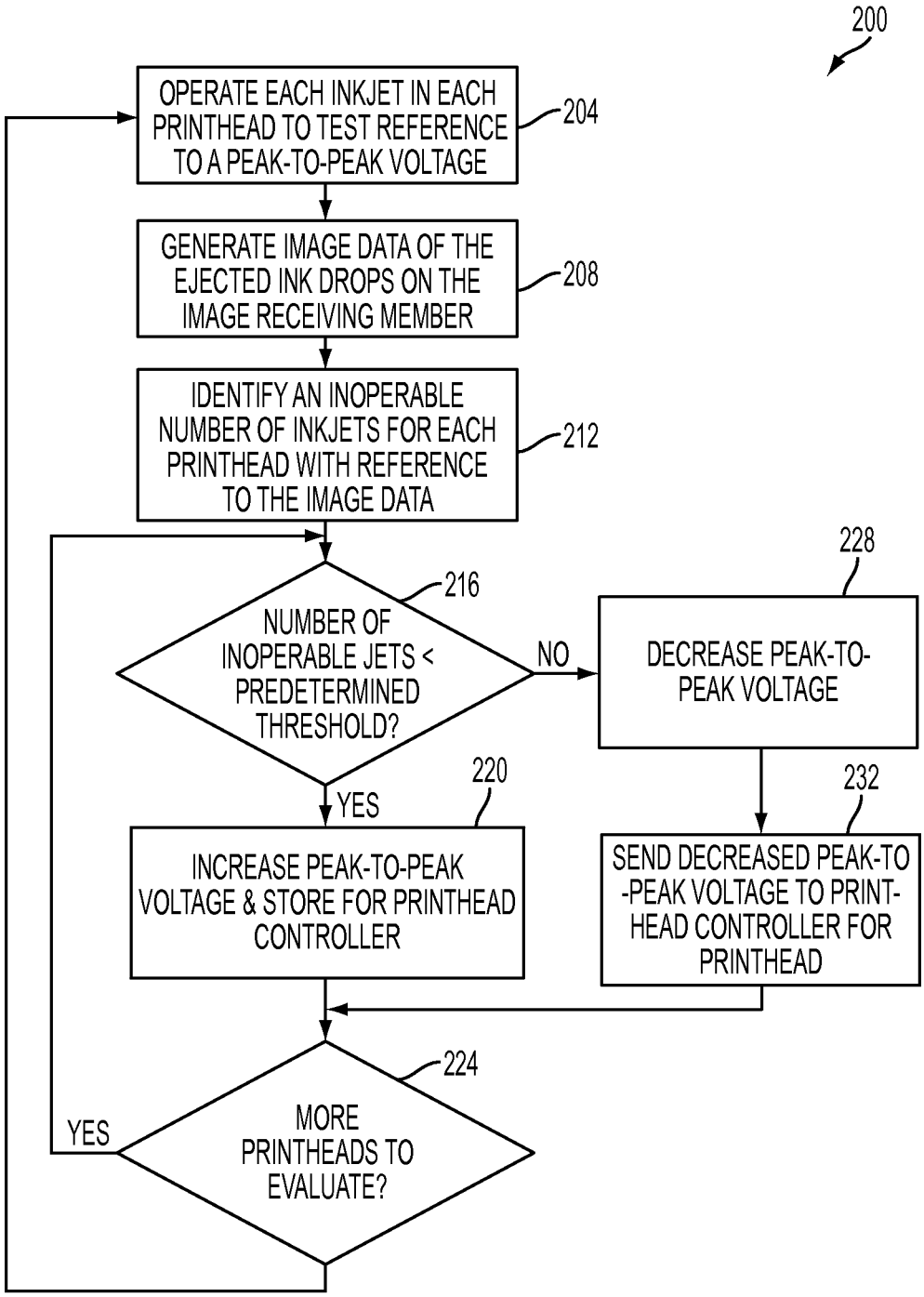
FIG. 3 is a flow diagram of a first embodiment of a process for adjusting the peak-to-peak voltage parameter of an electrical driving signal.

A process 200 by which the controller 128 identifies the parameters for the electrical driving signals generated by the printhead controllers is shown in FIG. 3. The controller generates and sends a signal to a plurality of printhead controllers that causes the printhead controller to operate each of the inkjets in each of the printheads operatively connected to the printhead controller (block 204). The printhead controllers generate electrical driving signals with reference to the peak-to-peak voltage parameter stored at the printhead controller that may be, for example, the original peak-to-peak voltage value calibrated during the printhead manufacturing process. The optical sensor generates image data corresponding to the ink drops that landed on the image receiving member (block 208). The controller analyzes the image data with reference to the electrical signals sent to the printhead controller to identify a number of inoperable inkjets for each printhead (block 212). One or more missing pixels at locations where an operated inkjet should have ejected an ink drop indicate an inoperable inkjet. The controller adjusts the peak-to-peak voltage parameter for a printhead with reference to the number of inoperable inkjets. In one embodiment, this adjustment is made by comparing the number of inoperable inkjets with a predetermined threshold (block 216) and increasing the peak-to-peak voltage parameter for a printhead in response to the number of inoperable inkjets being lower than the predetermined threshold (block 220). The increased voltage parameter is sent to the printhead controller that operates the printhead for storage (block 220). The controller determines whether all of the printheads have been evaluated (block 224) and if they have, then the process is repeated with the new peak-to-peak voltage parameters (block 204). If printheads remain to be evaluated, then the process continues to compare the number of inoperable inkjets for a next printhead to the predetermined threshold to determine whether the peak-to-peak voltage parameter is increased (block 220) or decreased (block 228). If the peak-to-peak voltage parameter is decreased (block 228), the decreased peak-to-peak voltage parameter is sent to the printhead controller for the printhead for storage (block 232). When the process is repeated to evaluate new peak-to-peak voltage parameters (blocks 204-216), the printheads for which the new peak-to-peak voltage parameter was obtained by decreasing the peak-to-peak voltage (block 228) are removed from the evaluation process as the decreased peak-to-peak voltage parameter is considered optimal for the current condition of the printhead. The process is repeated until a new peak-to-peak voltage parameter is identified for the printhead by decreasing the tested parameter (block 228). This procedure helps ensure that the peak-to-peak voltage parameter has been set to the largest amplitude without reaching a voltage that produces an unacceptable number of inoperable inkjets in the printhead.

Figure 4:
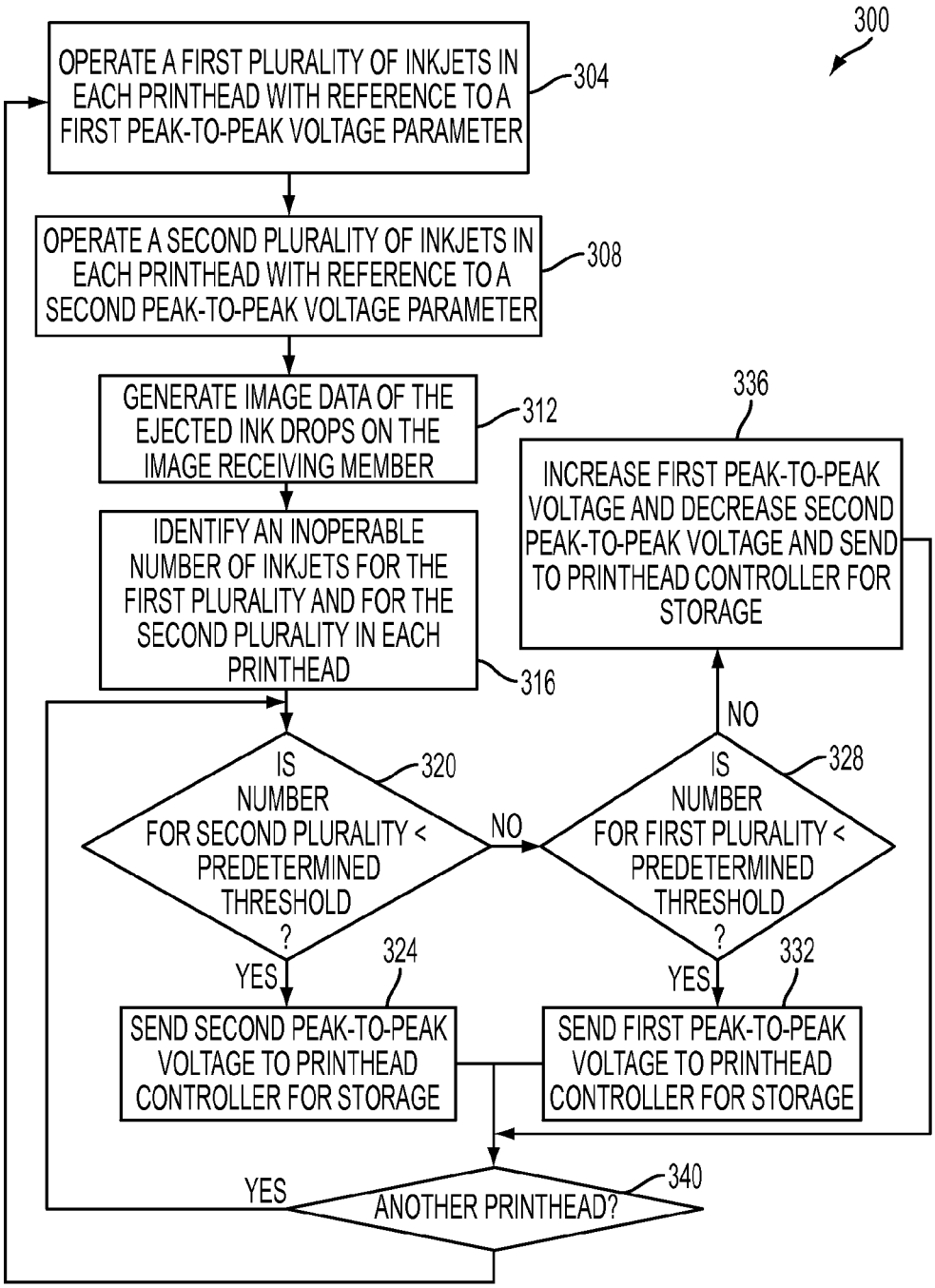
FIG. 4 is a flow diagram of a second embodiment of a process for adjusting the peak-to-peak voltage parameter of an electrical driving signal.

In an alternative process embodiment shown in FIG. 4, the inkjets in the printheads operatively connected to a printhead controller are operated a portion at a time with different peak-to-peak voltages. For example, a first driving signal is generated with reference to a first peak-to-peak voltage for one-half of the inkjets in each printhead to eject ink from those inkjet ejectors and a second driving signal is generated with reference to a second peak-to-peak voltage for the remaining one-half of the inkjets in each printhead to eject ink from those inkjet ejectors. The image data of the resulting ink drop pattern is then evaluated to identify the peak-to-peak voltage that provides the most robust image quality for the printhead. The printhead, however, could be divided into more than two sections of inkjets and operated in a manner similar to that described below for a two section printhead to evaluate more peak-to-peak voltages with a single pattern.

The process 300 begins by sending to the printhead controllers a signal that identifies a first plurality of inkjets to be operated in each printhead operatively connected to each printhead controller with reference to a first peak-to-peak voltage parameter (block 304). Similarly, the controller sends to the printhead controllers a signal that identifies a second plurality of inkjets to be operated in each printhead operatively connected to each printhead controller with reference to a second peak-to-peak voltage parameter (block 308). The first and second pluralities of inkjets are operated substantially simultaneously and the second peak-to-peak voltage is greater than the first peak-to-peak voltage.

The optical sensor then generates image data corresponding to the ink drops ejected from both the first plurality of inkjets and the second plurality of inkjets on the image receiving member (block 312). The controller analyzes the image data and identifies a first number of inoperable inkjets in the first plurality of inkjets and a second number of inoperable inkjets in the second plurality of inkjets for each printhead (block 312). The controller compares the second number of inoperable inkjets with a predetermined threshold (block 320). If the second number of inoperable inkjets is less than the predetermined threshold, then the second peak-to-peak voltage is identified as the new peak-to-peak voltage parameter for the printhead and is sent to the printhead controller that operates the printhead for storage (block 324). If the second number of inoperable inkjets is greater than the predetermined threshold, then the controller compares the first number of inoperable inkjets to the predetermined threshold (block 328). If the first number of inoperable inkjets is less than the threshold, the first peak-to-peak voltage is identified as the new peak-to-peak voltage parameter and sent to the printhead controller that operates the printhead for storage (block 332). Otherwise, the first peak-to-peak voltage is increased and the second peak-to-peak voltage is decreased and both voltages are sent to the printhead controller that operates the printhead for the next iteration of the process (block 336). After the peak-to-peak voltage(s) for a printhead have been identified, the controller determines if all the printheads have been evaluated (block 340). If all printheads have been evaluated, then the process is repeated for the printheads for which both the first and the second peak-to-peak voltages were adjusted. The process continues until a single peak-to-peak voltage parameter for each printhead has been identified.

This embodiment adjusts the peak-to-peak voltage for each printhead by testing different peak-to-peak voltages over different portions of a printhead to determine which peak-to-peak voltage achieves better print quality. If both peak-to-peak voltages are acceptable, the greater voltage is selected as the peak-to-peak voltage parameter for the printhead because that voltage achieves better print quality. In this way, the inkjet printer system can increase the peak-to-peak voltages of the electrical driving signals to compensate for decreased drop mass arising from drift in the performance of the inkjets in the printheads without increasing the peak-to-peak voltage so much that the reliability of the printheads is diminished. Performance drift in the inkjets of a printhead may be caused by thermal effects on the printhead, cycling of the actuators in the printhead, changes in the ink that affect viscosity and other ink performance parameters, and the like. Thus, this method can be used to maintain the printheads at a robust level of operation over the operational life of the printheads regardless of the cause of the deterioration in the performance of the inkjets in the printhead.

The process shown in FIG. 4 operates multiple pluralities of inkjets in the same printhead to enable the peak-to-peak voltage parameters to be adjusted with fewer iterations of the process. In particular, instead of operating all of inkjets in the printhead multiple times, as the process in FIG. 3 does, two pluralities of inkjets in the printhead can be operated once with a reasonable likelihood that one of the two peak-to-peak voltages can compensate for performance drift in the printhead. This method of operation is advantageous because it reduces the amount of time required to calibrate the inkjet printer.

In another alternative embodiment, multiple pluralities of inkjets are identified for each printhead operatively connected to each printhead controller and they are operated substantially simultaneously with reference to a different peak-to-peak voltage parameter for each plurality of inkjets. As noted above with the embodiment in FIG. 4, this method of operation enables multiple peak-to-peak voltages to be evaluated with a single pattern of ink drops printed by all of the printheads in the printer. After the number of inoperable inkjets is identified for each plurality of inkjets in each printhead, the numbers are compared to the predetermined threshold. The largest peak-to-peak voltage not exceeding the predetermined threshold is selected to be the new peak-to-peak voltage parameter and is sent to the corresponding printhead controller for storage and subsequent use in generating firing signals for the printheads operatively connected to the printhead controller. The process can be performed iteratively for the printheads for which no appropriate peak-to-peak voltage was identified until a single peak-to-peak voltage parameter is identified for each printhead.

In the methods noted above, the peak-to-peak voltage parameter is adjusted upwardly by the printer controller and then sent to the printhead controller, which uses the modified peak-to-peak voltage to generate the driving signals for the inkjets. As noted above, a calibration process is used at a manufacturing facility to identify the peak-to-peak voltage for each printhead controller. Additionally, some printers also calibrate an offset from the peak-to-peak voltage for each inkjet in a printhead and these offset voltages can be stored in memory for use by the printhead controller. Using the method described above in such printers, the printer controller receives adjusts the peak-to-peak voltage used by a printhead controller and the printhead controller generates the driving signals for individual inkjets with reference to the offsets stored in the memory of the printhead controller. In other embodiments, the printer controller receives the peak-to-peak voltage from a printhead controller and the offsets for the inkjets. In one embodiment, the printer controller uses the printhead peak-to-peak voltage parameter and the inkjet offsets to compute a peak-to-peak voltage for each inkjet and identifies an average peak-to-peak voltage for the printhead from the inkjet peak-to-peak voltages. This average peak-to-peak voltage is adjusted upwardly and sent to the printhead controller to use as the new printhead peak-to-peak voltage. In the analysis of the image data of the test pattern generated with reference to the new printhead peak-to-peak voltage, individual inkjets identified as being weak or inoperable, have their offsets adjusted and sent to the printhead controller for subsequent use. This process of adjusting the offset voltages would iterate until some threshold is reached. Thus, the individual inkjet peak-to-peak voltages could be adjusted for some or all of the inkjets.

A further refinement could occur in the printer controller performing statistical analysis on the inkjets to identify those inkjets that become weak or inoperable at a more statistically significant rate. The offsets for these inkjets can then be selected for adjustment. In some embodiments, the offsets for individual inkjets are timing parameters rather than peak-to-peak voltage offsets. Adjustments in the timing of the driving signals are also effective in compensating for weak and/or inoperable inkjets. Alternatively, the printer controller does not adjust the peak-to-peak voltage parameter for a printhead, but rather changes the offsets, which can be voltage offsets or timing parameters, for all or some of the inkjets. The changed offsets are returned to the printhead controller, which generates driving signals for the production of another test pattern. Analysis of the image data indicates whether additional adjustments of the offset parameters are required. These adjustments continue until a predetermined threshold is reached. Thus, the signal parameter adjusted in the processes described above is a printhead peak-to-peak voltage in some embodiments, offset parameters for inkjets in some embodiments, and both the peak-to-peak voltage and offset parameters in some embodiments.

Additionally, the methods described above specifically reference the peak-to-peak voltage parameter of a piezoelectric printhead. The method is used in other embodiments to affect other driving signal parameters. For example, any aspect of each printhead's electrical driving signal, such as peak values, pulse widths, slew rates, and the like may be adjusted to compensate for the detection of inoperable inkjets.

Although the description above pertains to adjustment of firing signal parameters for piezoelectric actuators, the method may be used in printheads that have other types of actuators, including: thermal, mechanical and continuous. For example, thermal printheads use actuators that are selectively heated by a driving signal to eject ink. These types of printheads also suffer deterioration in the performance of the inkjets over the life of the printhead. While these thermal actuators do not have peak-to-peak voltages, the driving signals still have maximum amplitudes, frequencies, and other parametric characteristics that affect the operation of the inkjets. Consequently, the method described above can be used to detect the missing pixels caused by performance drift and adjustments can be made to the driving signal parameters to compensate for the detected inoperable inkjets.

It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method of operating inkjets in a printhead comprising:

operating a first plurality of inkjets in a printhead with a first plurality of electrical signals generated with reference to a first signal parameter, each electrical signal in the first plurality of electrical signals operating only one inkjet in the first plurality of inkjets to eject a first plurality of ink drops onto an image receiving member;

generating image data corresponding to the first plurality of ink drops on the image receiving member with an optical sensor;

identifying a first number of inoperable inkjets in the first plurality of inkjets with reference to the image data;

adjusting the first signal parameter value with reference to the first number of inoperable inkjets by increasing the first peak-to-peak voltage value for the first plurality of inkjets in response to the first number of inoperable inkjets for the first plurality of inkjets being less than a predetermined threshold;

storing the adjusted first signal parameter in a memory for operation of the first plurality of inkjets in the printhead;

generating a second plurality of electrical signals having a second peak-to-peak voltage value that corresponds to the increased first peak-to-peak voltage value, each electrical signal in the second plurality of electrical signals operating only one inkjet in the first plurality of inkjets to eject a second plurality of ink drops onto the image receiving member;

generating image data corresponding to the second plurality of ink drops on the image receiving member with the optical sensor;

identifying a second number of inoperable inkjets in the first plurality of inkjets with reference to the image data corresponding to the second plurality of ink drops on the image receiving member; and decreasing the second peak-to-peak voltage value to a value between the increased first peak-to-peak voltage value and the initial peak-to-peak voltage value in response to the second number of inoperable inkjets identified with reference to the image data corresponding to the second plurality of ink drops on the image receiving member exceeding the predetermined threshold.

2. The method of claim 1 wherein each printhead in the plurality of printheads is a piezoelectric printhead.

3. A method of operating inkjets in a printhead comprising:

operating a first plurality of inkjets in a printhead with a first plurality of electrical signals generated with reference to a first signal parameter, each electrical signal in the first plurality of electrical signals operating only one inkjet in the first plurality of inkjets to eject a first plurality of ink drops onto an image receiving member;

generating image data corresponding to the first plurality of ink drops on the image receiving member with an optical sensor;

identifying a first number of inoperable inkjets in the first plurality of inkjets with reference to the image data;

adjusting the first signal parameter value with reference to the first number of inoperable inkjets;

storing the adjusted first signal parameter in a memory for operation of the first plurality of inkjets in the printhead;

operating a second plurality of inkjets in the printhead with a second plurality of electrical signals having a second peak-to-peak voltage value that is greater than the first peak-to-peak voltage, each electrical signal in the second plurality of electrical signals operating only one inkjet in the second plurality of inkjets in the printhead to eject a second plurality of ink drops onto the image receiving member substantially simultaneously with the ejection of the first plurality of ink drops onto the image receiving member;

generating image data corresponding to the second plurality of ink drops on the image receiving member with the optical sensor;

identifying a second number of inoperable inkjets in the second plurality of inkjets with reference to the image data;

adjusting the first and second peak-to-peak voltage values with reference to the first number of inoperable inkjets and the second number of inoperable inkjets; and storing the adjusted peak-to-peak voltage values for the first plurality of electrical signals and for the second plurality of electrical signals in a memory for operation of the first plurality of inkjets and the second plurality of inkjets in the printhead.

4. The method of claim 3, the adjusting the first and second peak-to-peak voltage values further comprising:

setting the first and second peak-to-peak voltage values for the first plurality of inkjets and for the second plurality of inkjets to the second peak-to-peak voltage value in response to the first number of inoperable inkjets and the second number of inoperable ink ejectors being less than a predetermined threshold; and setting the first and second peak-to-peak voltage values for the first plurality of inkjets and for the second plurality of inkjets to the first peak-to-peak voltage value in response to the first number of inoperable inkjets being less than the predetermined threshold and the second number of inoperable inkjets being greater than the predetermined threshold.

5. The method of claim 4, the adjusting the first and second peak-to-peak voltage values further comprising:

setting the first and second peak-to-peak voltage values for the first plurality of inkjets and for the second plurality of inkjets to the second peak-to-peak voltage value for the second plurality of electrical signals in response to the first number of inoperable inkjets being greater than the predetermined threshold and the second number of inoperable inkjets being less than the predetermined threshold.

6. A method of operating inkjets in a plurality of printheads comprising:

operating a plurality of inkjets in each printhead in the plurality of printheads with a plurality of electrical signals for each printhead in the plurality of printheads, the plurality of electrical signals having a first peak-to-peak voltage value, each electrical signal in each plurality of electrical signals for one printhead operating only one inkjet in the plurality of inkjets of the one printhead to eject a plurality of ink drops onto an image receiving member;

generating image data corresponding to the plurality of ink drops ejected by each printhead onto the image receiving member with an optical sensor;

identifying a number of inoperable inkjets in the plurality of inkjets in each printhead in the plurality of printheads;

adjusting the first peak-to-peak voltage value for the plurality of electrical signals for each printhead in the plurality of printheads with reference to the identified number of inoperable inkjets in each printhead in the plurality of printheads by setting the first peak-to-peak voltage value for each printhead in the plurality of printheads to a second peak-to-peak voltage value corresponding to a largest peak-to-peak voltage value for a printhead in the plurality of printheads having a number of inoperable inkjets that is less than a predetermined threshold;

storing the adjusted peak-to-peak voltage value for each printhead in a memory for operation of the plurality of inkjets in each printhead;

operating each printhead in the plurality of printheads with a second plurality of electrical signals having the second peak-to-peak voltage value to eject a second plurality of ink drops onto the image receiving member;

generating image data corresponding to the second plurality of ink drops on the image receiving member with the optical sensor;

identifying a number of inoperable inkjets in the plurality of inkjets for each printhead in the plurality of printheads with reference to the image data corresponding to the second plurality of ink drops on the image receiving member; and decreasing the second peak-to-peak voltage value for each printhead having a number of inoperable inkjets that is greater than the predetermined threshold.

7. The method of claim 6 wherein each plurality of electrical signals has a first peak-to-peak voltage value that is different than the first peak-to-peak voltage values for the plurality of electrical signals for the other printheads in the plurality of printheads.

8. A method of operating inkjets in a plurality of printheads comprising:

operating a plurality of inkjets in each printhead in the plurality of printheads with a plurality of electrical signals for each printhead in the plurality of printheads, the plurality of electrical signals for each printhead having a first peak-to-peak voltage value that corresponds to the first peak-to-peak voltage value for the plurality of electrical signals for the other printheads in the plurality of printheads, each electrical signal in each plurality of electrical signals for one printhead operating only one inkjet in the plurality of inkjets of the one printhead to eject a plurality of ink drops onto an image receiving member;

generating image data corresponding to the plurality of ink drops ejected by each printhead onto the image receiving member with an optical sensor;

identifying a number of inoperable inkjets in the plurality of inkjets in each printhead in the plurality of printheads;

adjusting the first peak-to-peak voltage value for the plurality of electrical signals for each printhead in the plurality of printheads with reference to the identified number of inoperable inkjets in each printhead in the plurality of printheads, the first peak-to-peak voltage value being adjusted by increasing the first peak-to-peak voltage value for each printhead in the plurality of printheads in response to the identified number of inoperable inkjets for each printhead being less than a predetermined threshold; and storing the adjusted first peak-to-peak voltage value for each printhead in a memory for operation of the plurality of inkjets in each printhead.

9. An inkjet printing system comprising:

a plurality of printheads, each printhead in the plurality of printheads having a plurality of inkjets configured to eject ink drops onto an image receiving member;

an optical sensor configured to generate image data from light reflected from the ink drops on the image receiving member;

a memory configured to store a plurality of peak-to-peak voltage values for each printhead in the plurality of printheads; and a controller operatively coupled to the plurality of printheads, the optical sensor, and the memory, the controller being configured to:

operate the plurality of printheads with a plurality of electrical signals for each printhead, each plurality of electrical signals for operating a printhead in the plurality of printheads being generated with reference to a first signal parameter stored for the printhead in the memory, each electrical signal in the plurality of electrical signals for operating the printhead operating only one inkjet in the plurality of inkjets in the one printhead to eject a plurality of ink drops onto the image receiving member, identify a number of inoperable inkjets in the plurality of inkjets for each printhead with reference to image data corresponding to the plurality of ink drops on the image receiving member that were generated by the optical sensor, adjust the first signal parameter stored in the memory for each printhead with reference to the identified number of inoperable inkjets in each printhead;

operate each printhead in the plurality of printheads with a second plurality of electrical signals having the largest peak-to-peak voltage value to eject a second plurality of ink drops onto the image receiving member;

identify a number of inoperable inkjets in the plurality of inkjets for each printhead in the plurality of printheads with reference to image data generated by the optical sensor that corresponds to the second plurality of ink drops on the image receiving member; and decrease the largest peak-to-peak voltage value for each printhead having a number of inoperable inkjets that is greater than the predetermined threshold.

10. The system of claim 9 wherein each first signal parameter stored in the memory for each printhead is different than the first signal parameter stored for the other printheads in the plurality of printheads.

11. The system of claim 9, the controller being further configured to adjust the first signal parameter by adjusting a peak-to-peak voltage value stored for each printhead by setting the peak-to-peak voltage value for each printhead in the plurality of printheads to a largest peak-to-peak voltage value for a printhead in the plurality of printheads having a number of inoperable inkjets that is less than a predetermined threshold.

12. The system of claim 9 wherein each peak-to-peak voltage value stored in the memory for each printhead corresponds to the other peak-to-peak voltage values for the other printheads in the plurality of printheads.

13. The system of claim 12, the controller being further configured to:

increase the peak-to-peak voltage value stored for each printhead in the plurality of printheads in response to the identified number of inoperable inkjets for each printhead being less than a predetermined threshold.

14. The system of claim 9 wherein each printhead in the plurality of printheads is a piezoelectric printhead.

* * * * *